US012274914B1

(12) United States Patent
Zhao

(10) Patent No.: US 12,274,914 B1
(45) Date of Patent: Apr. 15, 2025

(54) PECTORAL EXERCISER

(71) Applicant: Ziyou Zhao, Shiji Town (CN)

(72) Inventor: Ziyou Zhao, Shiji Town (CN)

( * ) Notice: Subject to any disclaimer, the term of this patent is extended or adjusted under 35 U.S.C. 154(b) by 0 days.

(21) Appl. No.: 18/972,330

(22) Filed: Dec. 6, 2024

(51) Int. Cl.

| | |
|---|---|
| ***A63B 23/12*** | (2006.01) |
| ***A63B 21/00*** | (2006.01) |
| ***A63B 21/06*** | (2006.01) |
| ***A63B 23/035*** | (2006.01) |
| ***A63B 71/00*** | (2006.01) |

(52) U.S. Cl.
CPC ..... *A63B 23/1245* (2013.01); *A63B 21/0615* (2013.01); *A63B 21/4035* (2015.10); *A63B 23/03533* (2013.01); *A63B 71/0054* (2013.01)

(58) Field of Classification Search
CPC ..... A63B 23/03533; A63B 23/03541; A63B 23/1245; A63B 23/1263; A63B 21/008; A63B 21/0083; A63B 21/0615; A63B 21/0616; A63B 21/0617; A63B 21/4017; A63B 21/4019
See application file for complete search history.

(56) References Cited

U.S. PATENT DOCUMENTS 4,793,608 A 12/1988 Mahnke et al.
5,580,341 A * 12/1996 Simonson ..... A63B 23/03525 482/136
5,989,165 A * 11/1999 Giannelli ..... A63B 23/03533 482/136
6,254,516 B1 * 7/2001 Giannelli ..... A63B 23/1209 482/136
D613,350 S * 4/2010 Fenster ..... D21/675
7,713,179 B2 5/2010 Webber
7,938,760 B1 * 5/2011 Webber ..... A63B 21/15 482/137
8,075,459 B2 * 12/2011 Axelsson ..... A63B 23/1281 482/136
10,953,265 B2 3/2021 Aasa et al.
11,642,566 B2 * 5/2023 Ellis ..... A63B 21/4047 482/97
11,752,059 B2 * 9/2023 Taivainen ..... A63B 23/1209 601/5
11,759,668 B2 9/2023 Webber et al.
11,865,406 B2 * 1/2024 Hallor ..... A63B 23/0233
11,944,861 B1 * 4/2024 Goldberg ..... A63B 21/0616
2017/0340503 A1 * 11/2017 Turner ..... A61H 1/024
2023/0414989 A1 * 12/2023 Wang ..... A63B 23/12

* cited by examiner

*Primary Examiner* — Zachary T Moore
(74) *Attorney, Agent, or Firm* — Clement Cheng

(57) ABSTRACT

A right rotation arm is mounted to the frame at a right rotation arm main joint. The right rotation arm has a right rotation arm upper bar. The right rotation arm upper bar is mounted above the base. The left rotation arm is mounted to the frame at a left rotation arm main joint. The left rotation arm has a left rotation arm upper bar. The left rotation arm upper bar is mounted above the base. The right front weight swivel member is pivotally connected to the right rotation arm upper bar at a right front weight retainer pivot. The left front weight swivel member is pivotally connected to the left rotation arm upper bar at a left front weight retainer pivot.

14 Claims, 16 Drawing Sheets

PECTORAL EXERCISER

FIELD OF THE INVENTION

The present invention is in the field of pectoral weight exercisers.

DISCUSSION OF RELATED ART

A variety of different exercisers such as pectoral exercisers have been discussed in United States patents. For example, in U.S. Pat. No. 10,953,265 entitled "Connector For Weight Lifting Apparatus" by Jesper Aasa, and Björn Aasa, published Mar. 23, 2021, the inventors describe, "A connector for a weightlifting apparatus, the weightlifting apparatus having a sliding rail, and slots or lateral protrusions, the connector comprising a main body slidably attached to the sliding rail, a support arm having a support surface and extending outwardly from the main body, a rotational latching device having first and second opposing ends, the first opposing end for engaging the slots or lateral protrusions, and the second opposing end comprising a recess for receiving a barbell in a form—fit connection to achieve a rotationally rigid coupling such that rotation of the barbell is transferred to the rotational latching device, and an barbell lock to releasably lock the barbell in the recess. The support surface supports the barbell during free weight exercise when the barbell is not locked in the barbell lock, and when the first opposing end is engaged with the slots or lateral protrusions."

For example, in U.S. Pat. No. 5,989,165 entitled "Incline Press Apparatus For Exercising Regions of The Upper Body," by Raymond Giannelli, and Jerry K. Leipheimer, published Nov. 23, 1999, the inventors describes "An incline press exercise apparatus is provided. The incline press apparatus includes a Selectable weight mechanism and a support member which pivotably supports a pair of four bar linkage mechanisms. The four-bar linkage mechanisms are pivotably mounted at their rearward ends about axes which are disposed at an angle relative to a horizontal plane, i.e. are tilted relative to vertical, such that a pair of elongated bars of the four-bar linkage mechanisms travel in planes which are tilted relative to vertical. The tilted planes through which the four-bar linkage mechanisms travel enable the handles to travel along a slightly curvilinear downwardly diverging path which simulates as natural a human musculoskeletal pushing motion as possible."

For example, in U.S. Pat. No. 6,254,516 entitled "Shoulder Press Apparatus for Exercising Regions of The Upper Body," by Raymond Giannelli, and Jerry K. Leipheimer, published Jul. 3, 2001, the inventors describe "A shoulder press exercise apparatus is provided. The should der press apparatus includes a Selectable weight mechanism and a support member which pivotably supports a pair of four-bar linkage mechanisms. The four-bar linkage mechanisms are pivotably mounted at their rearward ends about axes which are disposed at an angle relative to a horizontal plane, i.e. are tilted relative to Vertical, Such that a pair of elongated bars of the four-bar linkage mechanisms travel in planes which are tilted relative to vertical. The tilted planes through which the four-bar linkage mechanisms travel enable the handles to travel along a slightly curvilinear downwardly diverging path which Simulates as natural a human musculoskeletal upward pushing motion as possible."

For example, in U.S. Pat. No. 4,793,608 entitled "Exercise Apparatus," by Parker E. Mahnke, and Ron Sheltra, published Dec. 27, 1988, the inventors describe "A multi-purpose exercise machine for accomplishing progressive resistance exercises. The machine comprises a free-standing frame including a single central guide column providing generally vertical, transversely spaced apart guide channels, a carriage movable upwardly and downwardly along the central guide column, two side by side stacks of weights disposed below the carriage, a pair of selector bars extending between the weights and the carriage; connecting means for connecting a selected number of weights to the selector bars, a body engaging means, such as a handlebar including gripping portions connected to the carriage for pivotal adjustment with respect thereto, a cable system operably interconnecting an overhead arm exercising subassembly and a bench mounted leg and arm exercising subassembly with the weights for use in performing various arm and leg exercises, and a fully adjustable exercise bench connected to the frame to support the trainee during the performance of a variety of different types of exercises using the bench mounted subassembly."

For example, in U.S. Pat. No. 5,580,341 entitled "Shoulder Press Machine and Method of Exercising," by Roy Simonson, published Dec. 3, 1996, the inventor describes "An apparatus and a method for performing a shoulder press exercise are disclosed. A user support and a primary hinge are mounted to a frame. A secondary hinge is mounted to the primary hinge. An arm mounted to the secondary hinge has a handle adapted to be grasped by the user. The two hinges permit the user to displace the handle in either or both the longitudinal and lateral directions. A means for resisting the displacement of the handle, preferably in both the lateral and longitudinal directions, is provided. The resistance means may include an incremental weight stack operably engaged to handle by belts directed by self-aligning pulleys. A second handle, arm and secondary hinge may be provided for the other hand so that the user may exercise both halves of his body. The arms may be connected such that both handles move the same longitudinal and/or lateral distance. To use the exercise machine, a user selects a weight for exercise, sits on the user support, grasps the handle and pushes upward from his shoulders, moving the handle longitudinally and laterally as he so chooses, overcoming the resistance."

For example, in U.S. Pat. No. 7,713,179 entitled "Dual Action Weightlifting Machine," by Randall T. Webber, published May 11, 2010, the inventor describes "A dual action weightlifting machine has a stationary frame and first and second spaced vertical guides slidably mounted on the stationary frame for horizontal sliding movement relative to the frame. A horizontally extending exercise bar assembly has spaced first and second vertical slides slidably mounted on the vertical guides for vertical sliding movement relative to the frame, a user engaging portion for gripping by a user when performing weightlifting exercises, and opposite end portions for receiving one or more selected weights. The user engaging portion is located between the vertical slides and rotatably mounted relative to the vertical slides for free rotation through 360 degrees, so that the user's hands may be rotated relative to the vertical slides while lifting weights."

For example, in U.S. Pat. No. 11,759,668 entitled "Exercise Machine with Lifting Arm," by Randall T. Webber, Bruce Hockridge, and Jeffrey O. Meredith, published Sep. 19, 2023, the inventors describe "An exercise machine has a main frame and a user support movably mounted relative to the main frame for movement between a start position and an end position during an exercise. At least one user engagement device is movably mounted relative to the main frame for engagement and actuation by a user during an exercise, and a connecting linkage translates movement of the user engagement device to movement of the user support. A lifting arm is movably mounted relative to the main frame associated with at least one the user support, user engagement device, and connecting linkage so as to move during an exercise. A load associated with the lifting arm provides resistance."

SUMMARY OF THE INVENTION

When exercising for some sports, a variety of different sports training builds one side of the body's muscles more than others. This may lead to lopsided pectoral muscles with one muscle larger than the other, such as if a right pectoral were larger than the left pectoral or if the left pectoral were larger than the right pectoral. The present invention is a pectoral exerciser with left and right individually adjustable weights. Working out one pectoral muscle more than the other can rebalance and reshape the shoulder and pectoral muscles with chest press exercises. Also, an adjustable weight can allow change of perceived weight without restacking weight plates.

A weight exerciser has a frame. The frame has a base. A right rotation arm is mounted to the frame at a right rotation arm main joint. The right rotation arm has a right rotation arm upper bar. The right rotation arm upper bar is mounted above the base. The left rotation arm is mounted to the frame at a left rotation arm main joint. The left rotation arm has a left rotation arm upper bar. The left rotation arm upper bar is mounted above the base. The right front weight swivel member is pivotally connected to the right rotation arm upper bar at a right front weight retainer pivot. The left front weight swivel member is pivotally connected to the left rotation arm upper bar at a left front weight retainer pivot. The right adjustment link is pivotally attached to the right front weight swivel member at a right front weight swivel member. The left adjustment link is pivotally attached to the left front weight swivel member at a left front weight swivel member.

The right selector body link is pivotally attached to the right rotation arm upper bar at the right selector body link pivot. The right selector body link is pivotally attached to the right adjustment link rear pivot. The left selector body link is pivotally attached to the left rotation arm upper bar at the left selector body link pivot. The left selector body link is pivotally attached to the left adjustment link rear pivot. The right front weight retainer is attached to the right front weight swivel member. The left front weight retainer is attached to the left front weight swivel member. The right rotation arm lower bar is rigidly connected to the right rotation arm upper bar. The left rotation arm lower bar is rigidly connected to the left rotation arm upper bar. The right rotation arm lower bar is mounted below the right rotation arm upper bar. The left rotation arm lower bar is mounted below the left rotation arm upper bar. The right rotation arm bar handle is mounted to the right rotation arm lower bar. The left rotation arm bar handle is mounted to the left rotation arm lower bar. The left rotation arm bar handle extends inwardly from the left rotation arm lower bar. The right rotation bar handle extends inwardly from the right rotation arm lower bar.

A right rotation arm weight extension extends from the right rotation arm, and a left rotation arm weight extension extends from the left rotation arm. The foot spotter includes a foot pedal attached to a foot spotter lever. The foot spotter lever is attached to a foot spotter link. The foot spotter link is configured to rotate a foot spotter bar. The foot spotter bar actuates a right spotter lift link and a left spotter lift link. The right spotter lift link is pivotally connected to the right rotation arm. The left spotter lift link is pivotally connected to the left rotation arm. The foot spotter foot pedal actuates the right rotation arm and the left rotation arm upwardly when in a depressed mode.

The right selector body is mounted to the right rotation arm upper bar. The left selector body is mounted to the left rotation arm upper bar. The right selector body connects to the right selector body link at a right selector body pin. The left selector body connects to the left selector body link at a left selector body pin. The right selector body pin removably connects to a right selector body anchor point. The left selector body pin removably connects to a left selector body anchor point. The right selector body anchor point is plural such that there is a first right selector body anchor point, a second right selector body anchor point, a third right selector body anchor point, a fourth right selector body anchor point, and a fifth right selector body anchor point. The right link has a first right link position, a second right link position, a third right link position, a fourth right link position, and a fifth right link position. The first right link position corresponds to the first right selector body anchor point. The second right link position corresponds to the second right selector body anchor point. The third right link position corresponds to the third right selector body anchor point. The fourth right link position corresponds to the fourth right selector body anchor point. The fifth right link position corresponds to the fifth right selector body anchor point. The right selector body pin is configured to engage the first right selector body anchor point, the second right selector body anchor point, the third right selector body anchor point, the fourth right selector body anchor point and the fifth right selector body anchor point. The left selector body anchor points are plural such that there is a first left selector body anchor point, a second left selector body anchor point, a third left selector body anchor point, a fourth left selector body anchor point, and a fifth left selector body anchor point. The left link has a first left link position, a second left link position, a third left link position, a fourth left link position, and a fifth left link position. The first left link position corresponds to the first left selector body anchor point. The second left link position corresponds to the second left selector body anchor point. The third left link position corresponds to the third left selector body anchor point. The fourth left link position corresponds to the fourth left selector body anchor point. The fifth left link position corresponds to the fifth left selector body anchor point. The left selector body pin is configured to engage the first left selector body anchor point, the second left selector body anchor point, the third left selector body anchor point, the fourth left selector body anchor point and the fifth left selector body anchor point. The right selector body pin is mounted on the selector body link and locks a position of the selector body link, a position of the adjustment link, and a position of the front weight swivel member when the right selector body pin is engaged to the first right selector body. The right selector body pin travels in an arc path when in a free mode, and is locked in a locked mode. The first right selector body anchor point is formed as an opening configured to receive the right selector body pin. The second right selector body anchor point is formed as an opening configured to receive the right selector body pin. The third right selector body anchor point is formed as an opening configured to receive the right selector body pin. The fourth right selector body anchor point is formed as an opening to receive the right selector body pin. The fifth selector body anchor point is formed as an opening to receive the right selector body pin. The left selector body pin is mounted on the selector body link and locks a position of the selector body link, a position of the adjustment link, and a position of the front weight swivel member when the left selector body pin is engaged to the first left selector body. The left selector body pin travels in an arc path when in a free mode, and is locked in a locked mode. The first left selector body anchor point is formed as an opening configured to receive the left selector body pin. The second left selector body anchor point is formed as an opening configured to receive the left selector body pin. The third left selector body anchor point is formed as an opening configured to receive the left selector body pin. The fourth left selector body anchor point is formed as an opening to receive the left selector body pin. The fifth selector body anchor point is formed as an opening to receive the left selector body pin.

Figure 1:
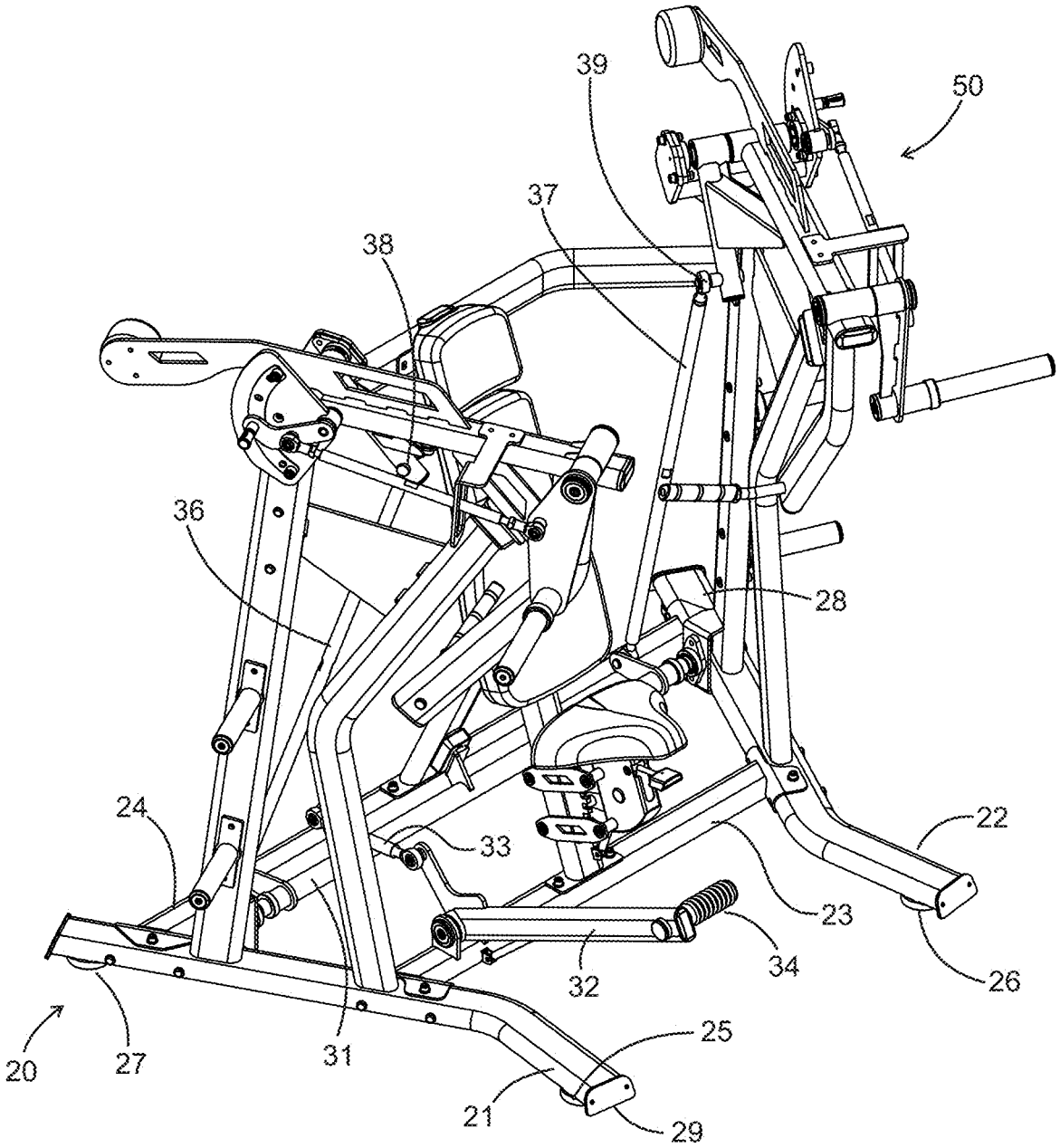
FIG. 1 is a right perspective view of the present invention.
Figure 2:
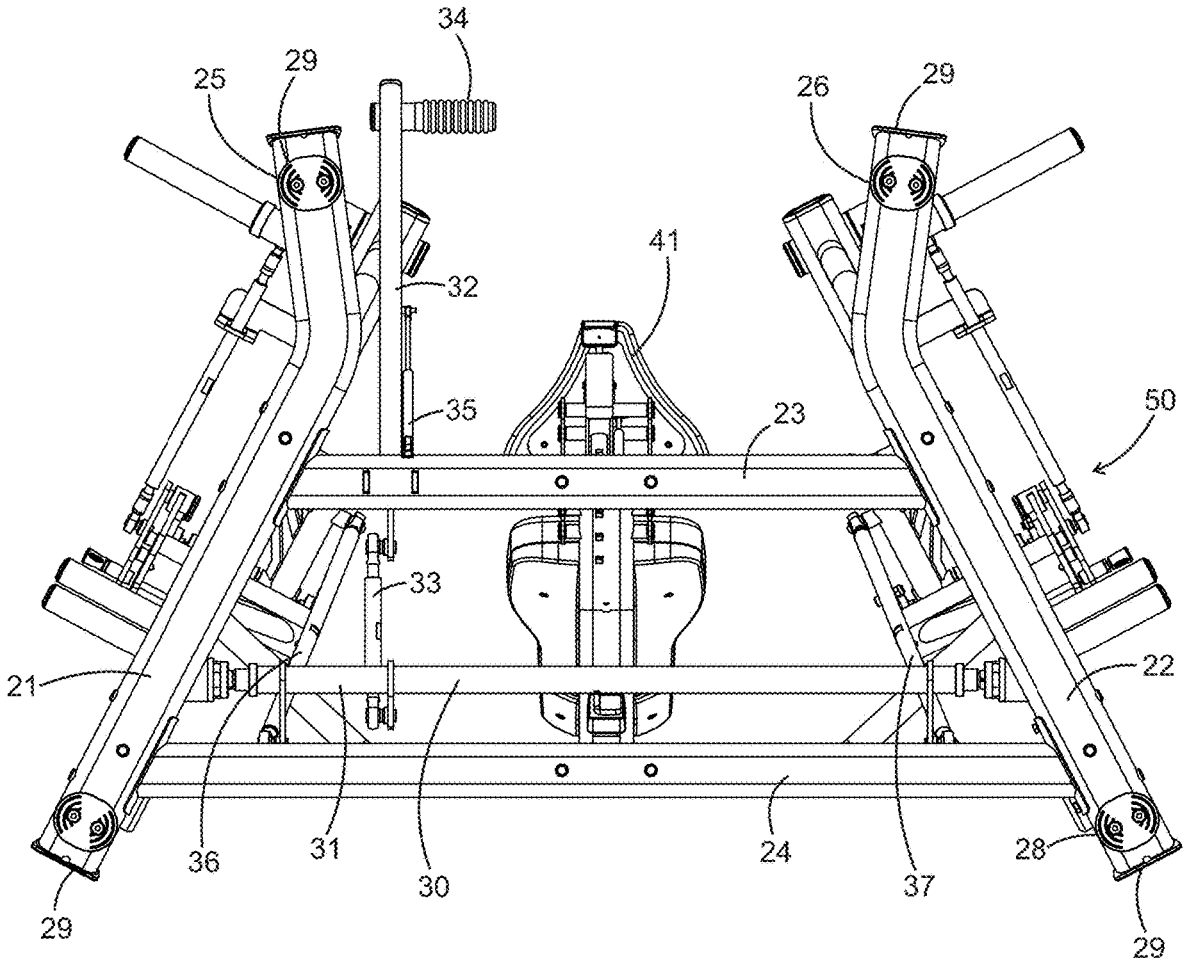
FIG. 2 is a bottom view of the present invention.

The following call out list of elements can be a useful guide in referencing the element numbers of the drawings.

20 base
21 right base foot
22 left base foot
23 front base cross beam
24 rear base cross beam
25 front right pad
26 front left pad
27 rear right pad
28 rear left pad
29 base foot endcap
30 foot spotter
31 foot spotter bar
32 foot spotter lever
33 foot spotter link
34 foot pedal
35 foot spotter lever flange
36 right spotter lift link
37 left spotter lift link
38 right spotter lift link connection
39 left spotter lift link connection
40 frame
41 right frame
42 left frame
43 right frame rack
44 left frame rack
45 right frame stop
46 left frame
47 right frame bridge
48 left frame bridge
49 frame to foot connection
50 rotation arm
51 rotation arm weight extension
52 rotation arm rear weight
53 rotation arm main joint
54 rotation arm upper bar
55 rotation arm lower bar
56 rotation arm bar handle
57 rotation arm abutment
58 rotation arm weight joint
59 rotation arm bar connector
60 front weight assembly
61 front weight retainer
62 front weight swivel member
63 front weight retainer pivot
64 selector body
65 selector body link
66 selector body link pivot
67 selector body pin
68 selector body path
69 selector body anchor point
71 adjustment link rear pivot
72 adjustment link front pivot
73 safety retainer
74 safety retainer opening
75 front weight retainer stop
80 link position
81 first link position
82 second link position
83 third link position
84 fourth link position
85 fifth link position
91 seat
92 back rest
93 head rest
94 lower seat back support member
95 upper seatback support member
96 seat height adjustment assembly
150 right rotation arm
152 right rotation arm rear weight
153 right rotation arm main joint
154 right rotation arm upper bar
155 right rotation arm lower bar
156 right rotation arm bar handle
158 right rotation arm weight joint
161 right front weight retainer
164 right selector body
165 right selector body link
167 right selector body pin
250 left rotation arm
252 left rotation arm rear weight
253 left rotation arm main joint
254 left rotation arm upper bar
255 left rotation arm lower bar
256 left rotation arm bar handle
258 left rotation arm weight joint
261 left front weight retainer
264 left selector body
265 left selector body link
267 left selector body pin
601 adjustment link forward pivot

602 adjustment link rear pivot
650 adjustment link
888 weight plate
1650 right adjustment link
2650 left link adjustment link

DETAILED DESCRIPTION OF THE PREFERRED EMBODIMENT

As seen in the first figure, the pectoral exerciser has a base 20 with a right base foot 21 and a left base foot 22. The right base foot 21 has a rear right pad 27 and a front right pad 25 preferably with helical threaded shafts to allow leveling. The right base foot 21 has a base foot endcap 29 that covers an open end of the flat rectangular tubular structure of the right base foot 21. Similarly, the left base foot 22 has a front left pad 26 and a rear left pad 28 also preferably with helical threaded shafts to allow leveling. The right base foot 21 connects to the left base foot 22 at a rear base crossbeam 25. The front base crossbeam 23 also connects the left base foot 22 to the right base foot 21. The rear base crossbeam 24 is behind the front base crossbeam 23 and is parallel to the front base crossbeam 23. The wide base allows a stable movement for a right and left weight.

A user can self spot using a foot pedal 34. The foot pedal 34 rotates a foot spotter lever 32. The foot spotter lever 32 actuates a foot spotter link 33. The foot spotter link 33 is pivotably attached to a foot spotter bar 31. The foot spotter bar 31 rotates when a user depresses the foot pedal 34. The foot spotter bar 31 intern actuates a right spotter lift link 36 and a left spotter lift link 37 which raise the right and left weight. Thus, a user can max out on pectorals and use a foot for self spotting.

As seen in the second figure, the foot pedal 34 extends horizontally in front of the user and a front of the seat 91. The foot spotter lever 32 connects to a foot spotter lever flange 35. The foot spotter lever flange 35 has a horizontal offset from the foot spotter link 33. The foot spotter link 33 is mounted distally from the foot spotter lever 32. The rear base crossbeam 24 can receive a mounting for the seat 91. Similarly, the front base crossbeam 23 can also receive a mounting for the seat 91.

The right spotter lift link 36 and the left spotter lift link 37 are angled inwardly toward the seat 91 such that the front ends of the lift links are closer together than rear ends of the lift links. The right base foot 21 and the left base foot 22 are also angled inwardly such that the front right pad 25 and the front left pad 26 are closer together than the rear right pad 27 and the rear left pad 28.

As seen in the third figure, the right weight is supported on a right frame 41 and the left weight is supported on the left frame 42. The right frame 41 has a right frame rack 43 and the left frame 42 has a left frame rack 44. The frame 40 has a frame to foot connection 49. The right frame bridge 47 bridges across the front and rear vertical members of the right frame 41. The left frame bridge 48 bridges across the front and rear members of the left frame 42. The right frame has a right frame stop 45. The left frame has a left frame stop 46. The right frame 41 and the left frame 42 angle inwardly toward the seat 91.

Figure 3:
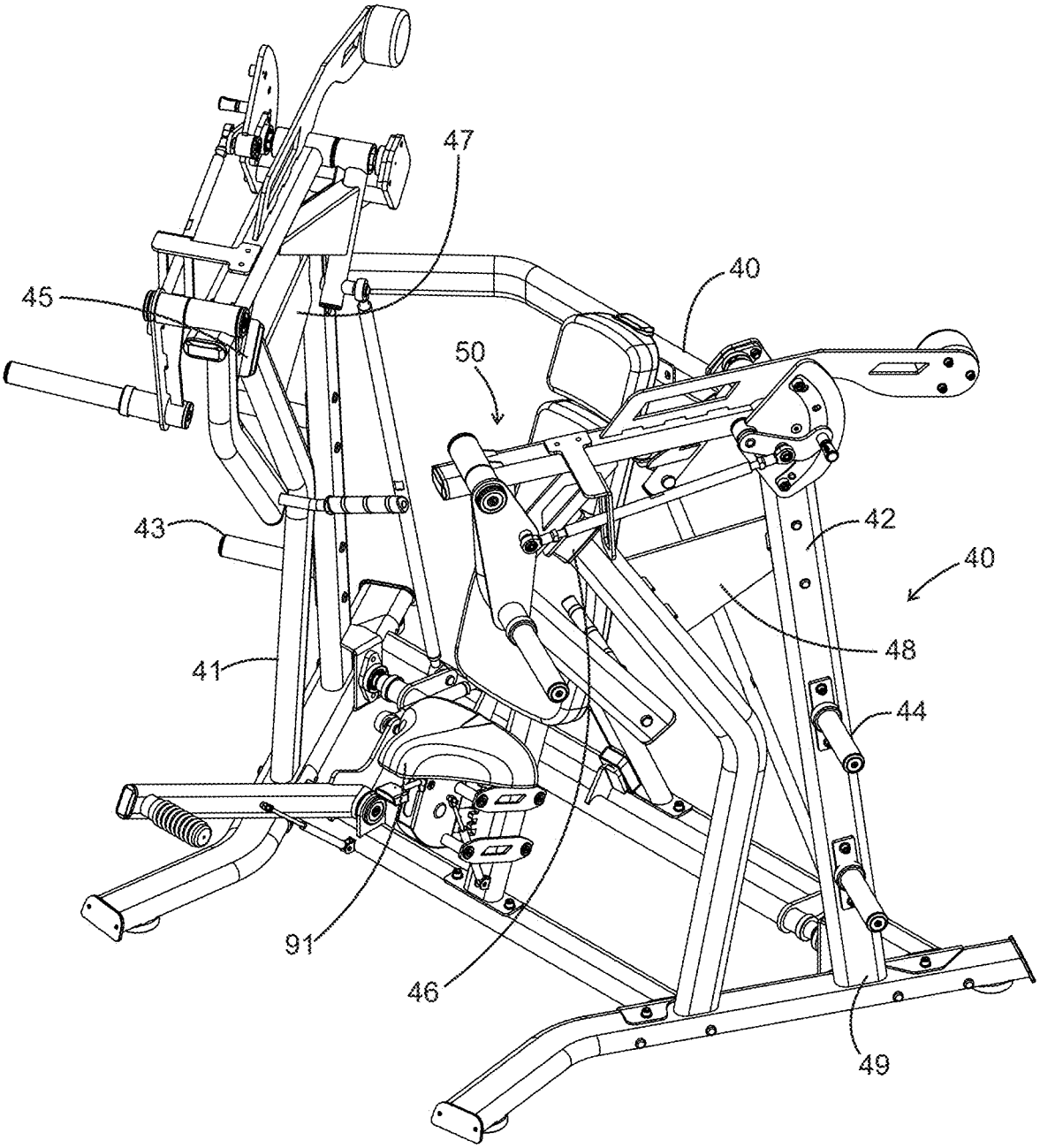
FIG. 3 is a left perspective view of the present invention.
Figure 4:
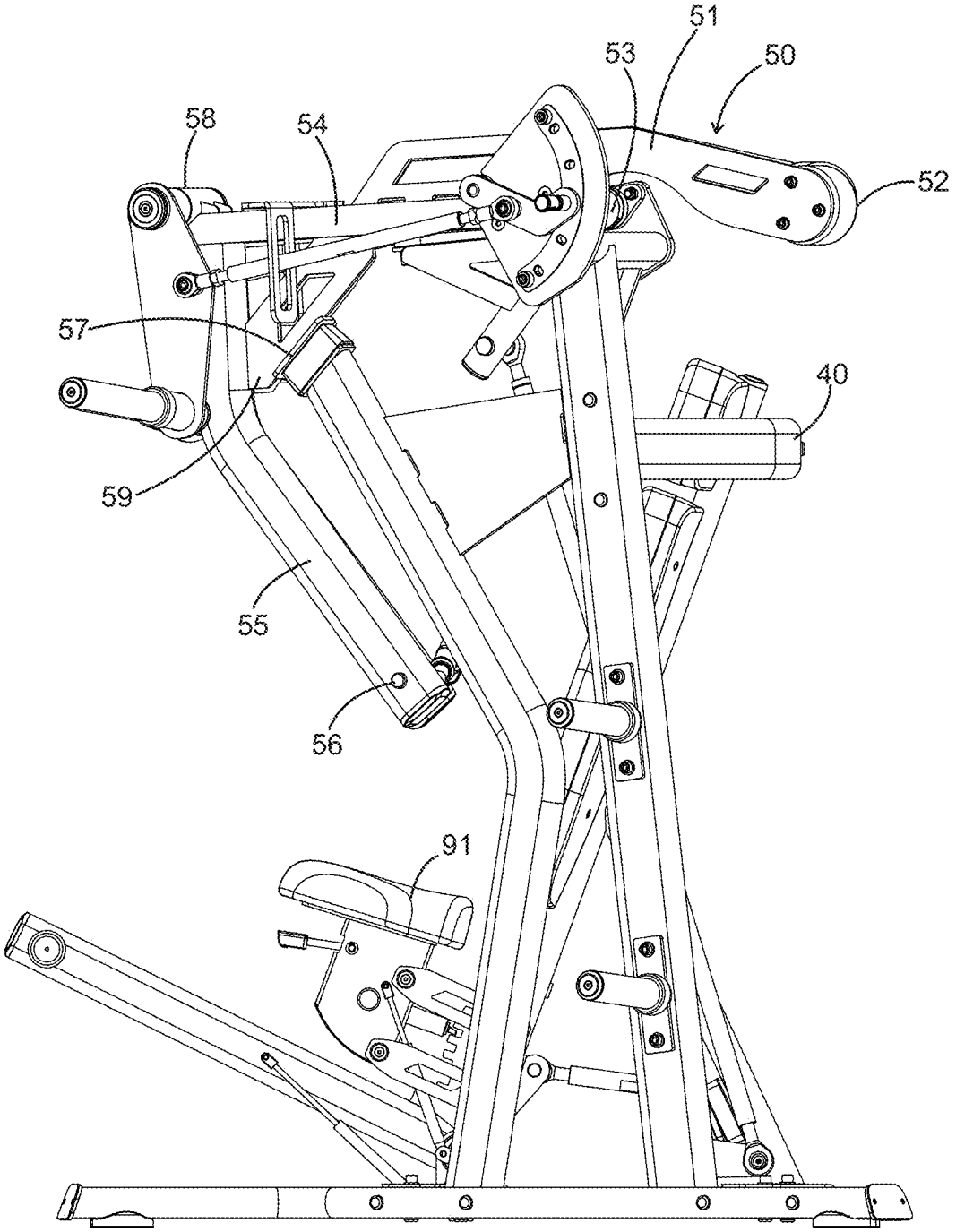
FIG. 4 is a left side view of the present invention.
Figure 5:
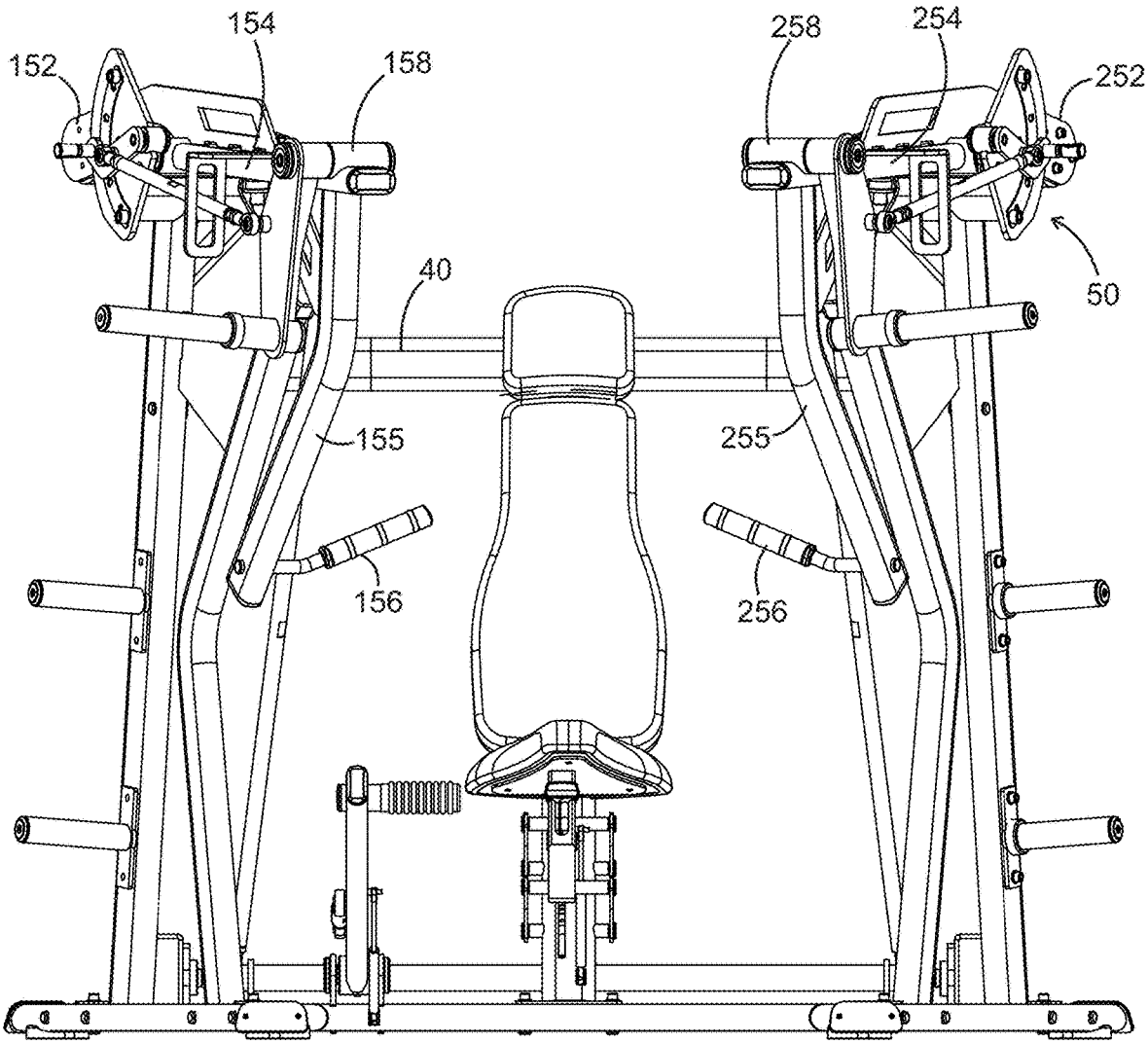
FIG. 5 is a front view of the present invention.
Figure 6:
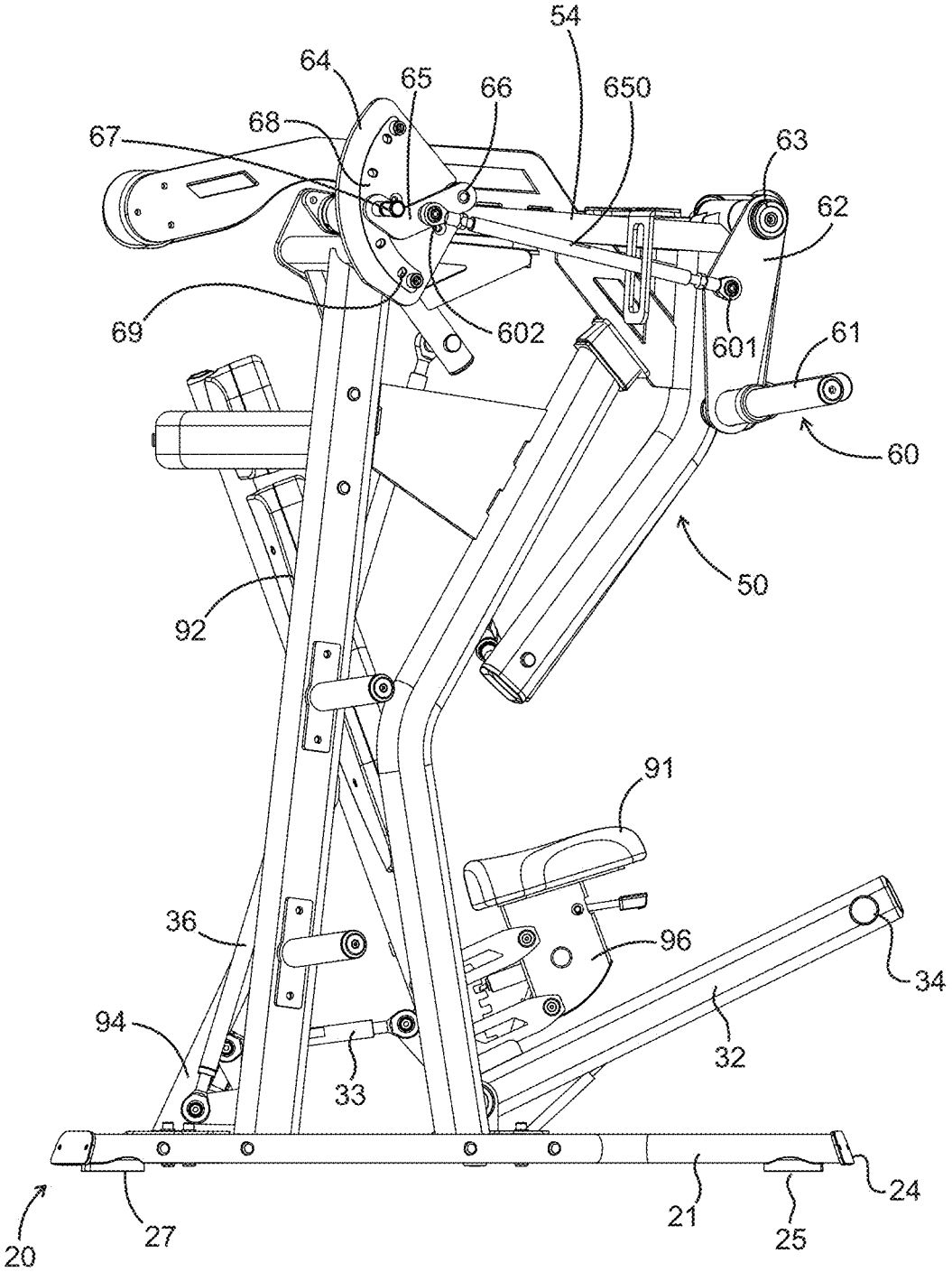
FIG. 6 is a right side view of the present invention.
Figure 7:
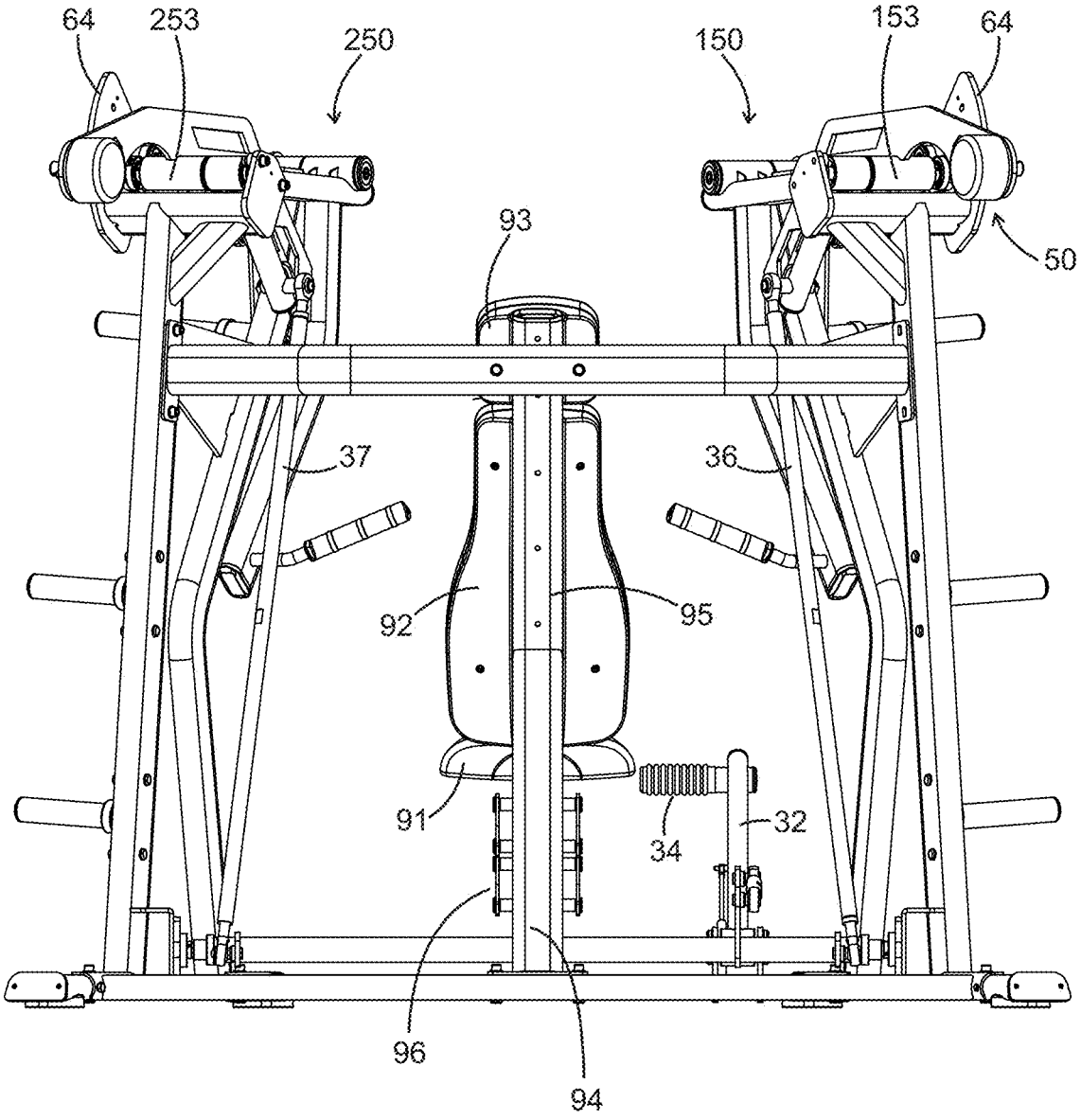
FIG. 7 is a rear view of the present invention.
Figure 8:
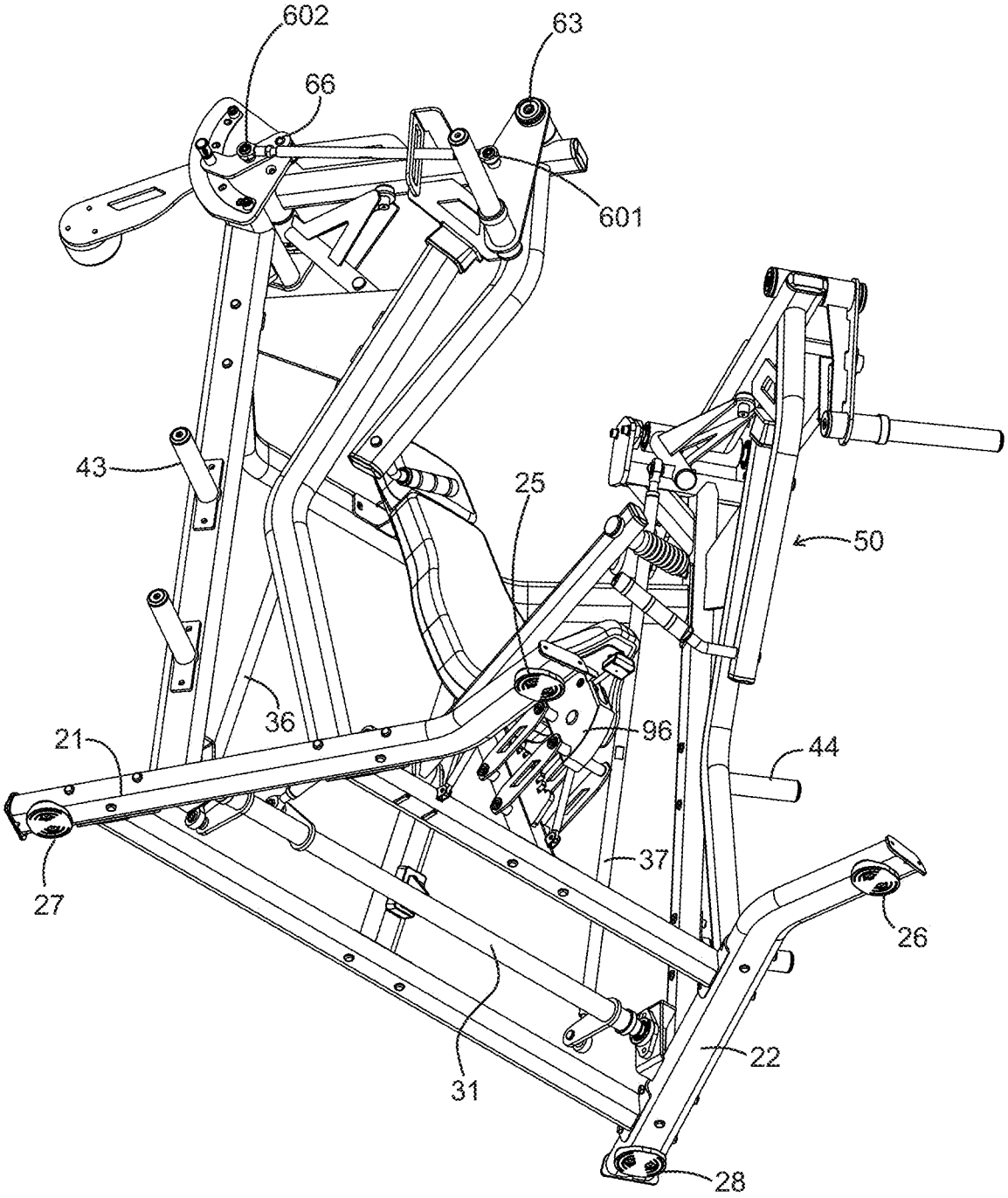
FIG. 8 is a lower left view of the present invention.
Figure 9:
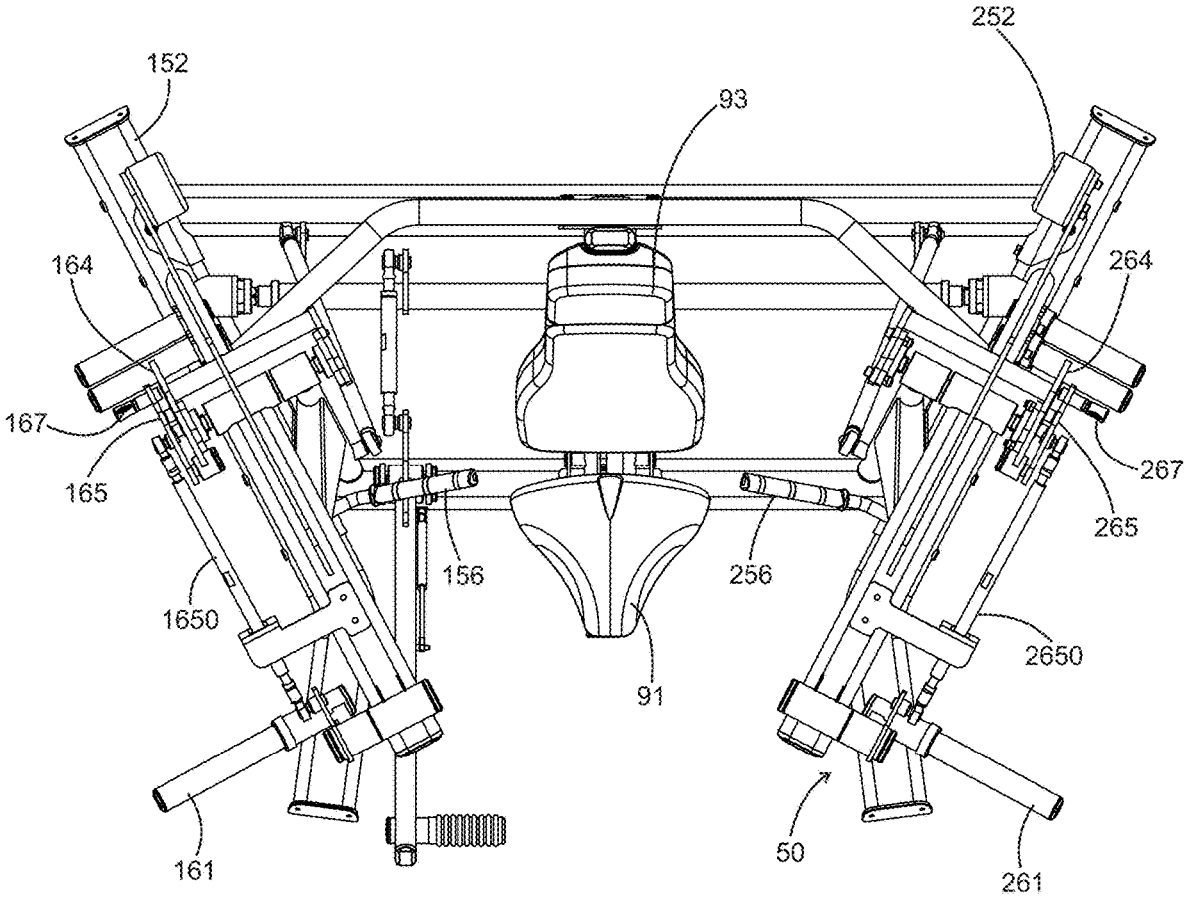
FIG. 9 is a top view of the present invention.
Figure 10:
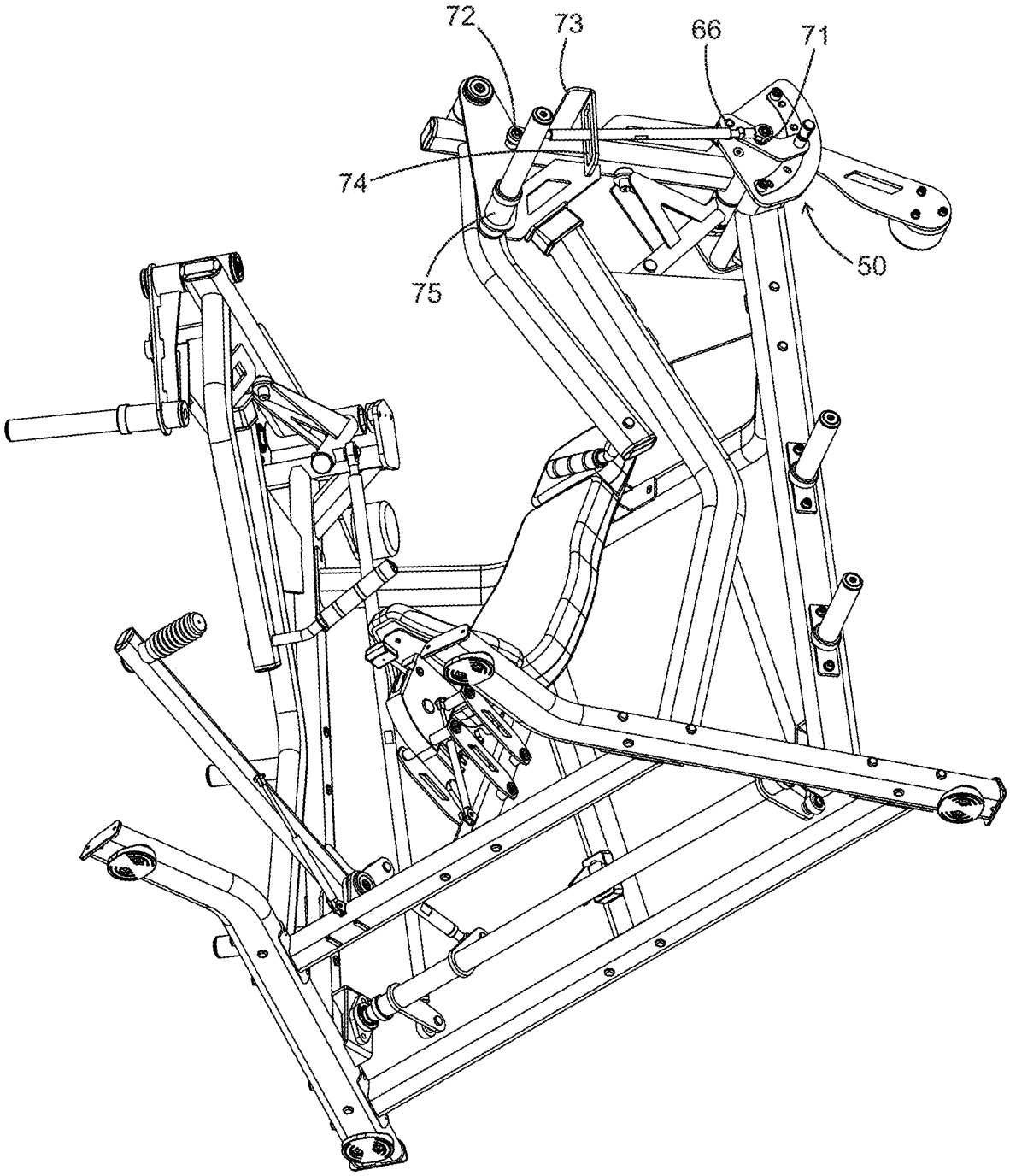
FIG. 10 is a lower right view of the present invention.
Figure 11:
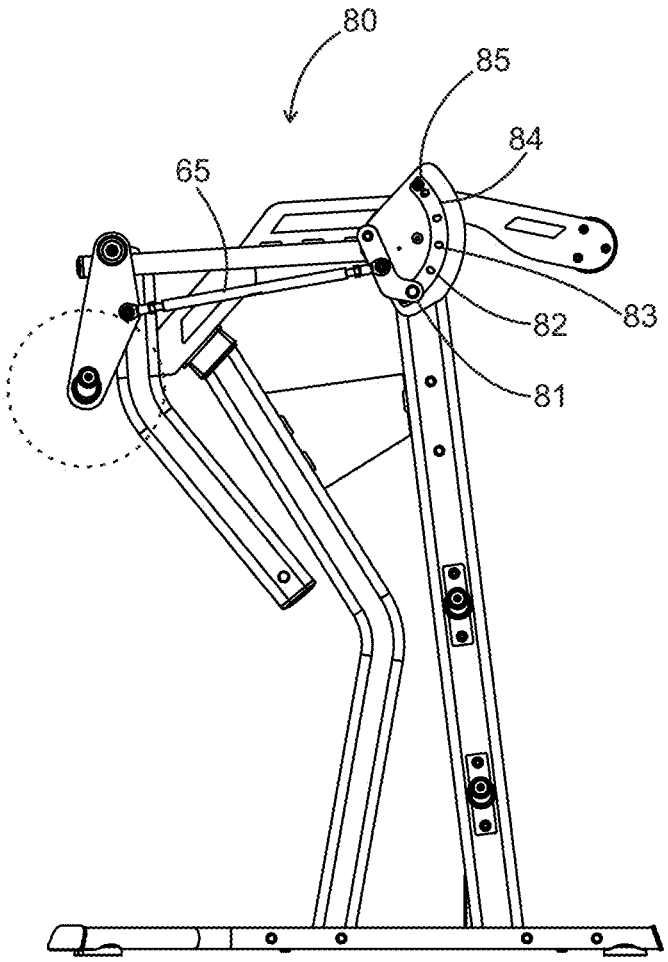
FIG. 11 is a side view of the present invention with the first link position engaged.
Figure 12:
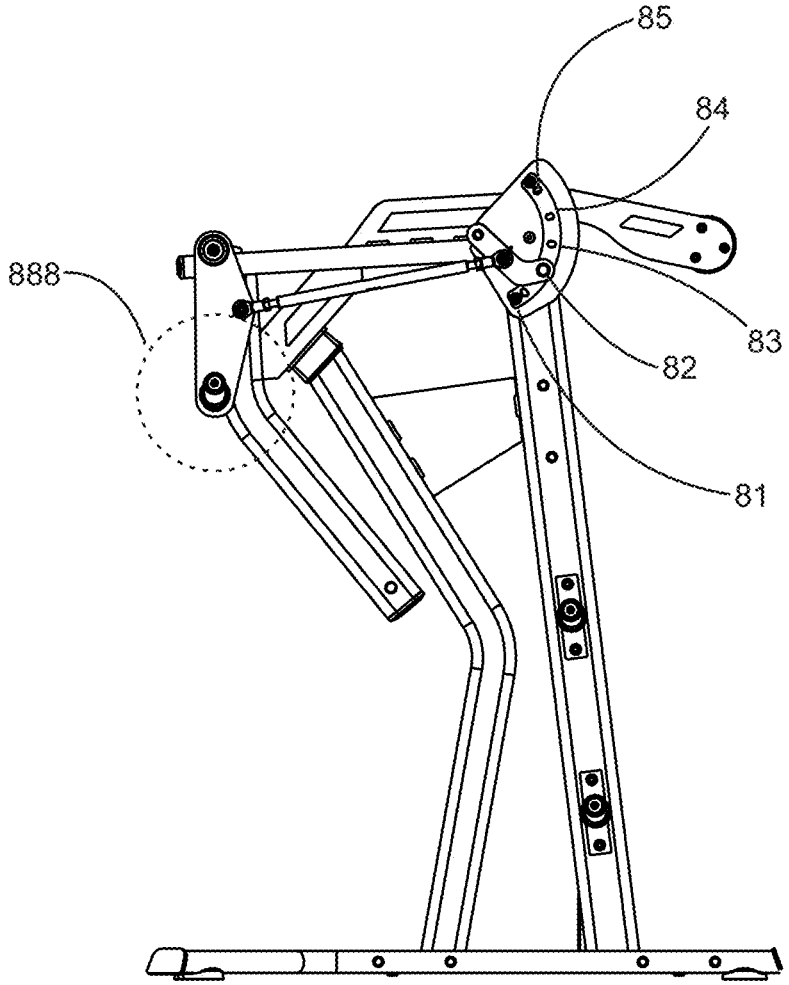
FIG. 12 is a side view of the present invention with the second link position engaged.
Figure 13:
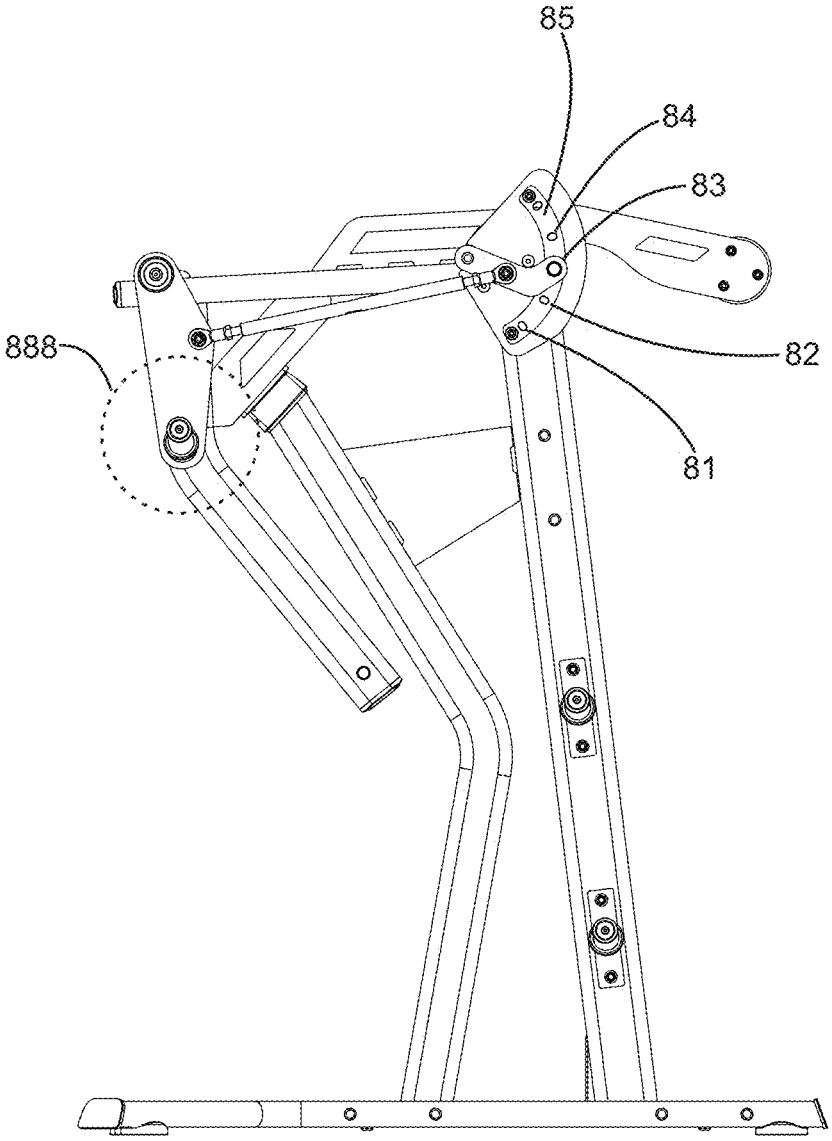
FIG. 13 is a side view of the present invention with the third link position engaged.
Figure 14:
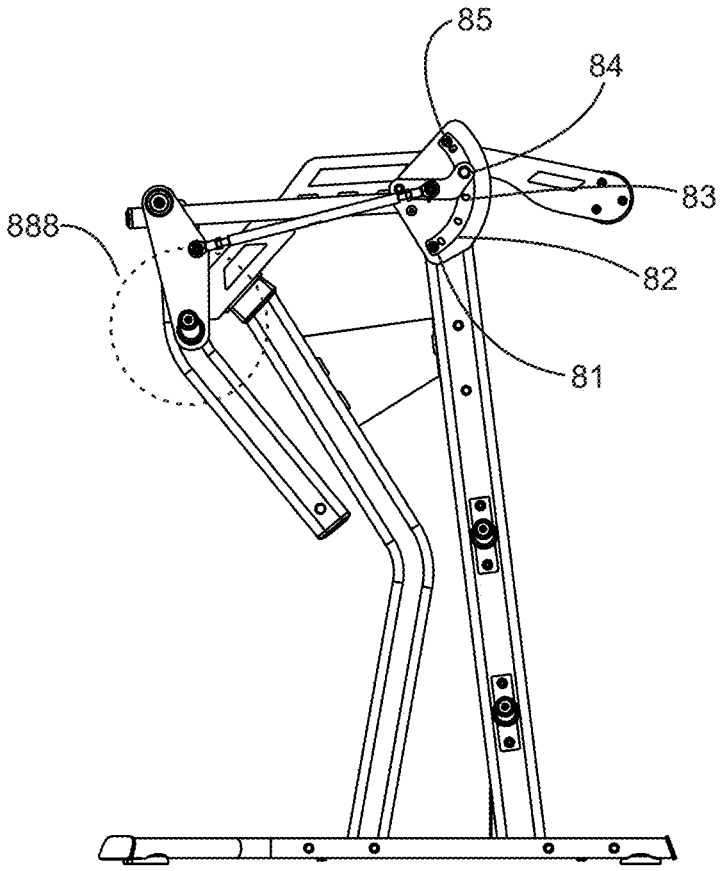
FIG. 14 is a side view of the present invention with the fourth link position engaged.
Figure 15:
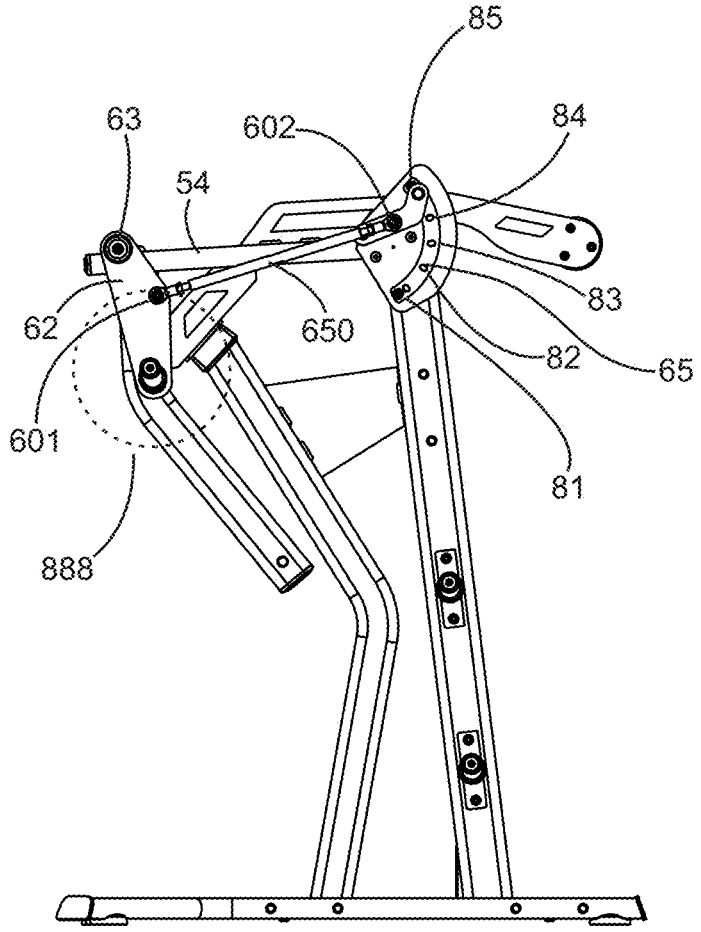
FIG. 15 is a side view of the present invention with the fifth link position engaged.
Figure 16:
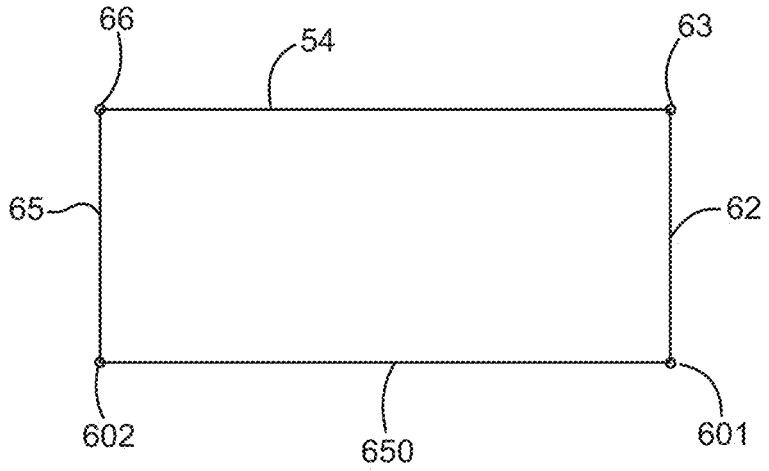
FIG. 16 is a four bar mechanism diagram.

As seen in the fourth figure, the frame 40 supports the seat 91 and the user actuates the weight mounted on the rotation arm 50 at a right and left rotation arm bar handle 56. The rotation arm 50 includes the right and left rotation arm bar handle 56, the rotation arm lower bar 55, the rotation arm bar connector 59, the rotation arm upper bar 54, and the rotation arm weighted extension 51. The right and left rotation arm bar handle 56 extends perpendicularly from a rotation arm lower bar 55. The rotation arm lower bar begins at an angle that is generally diagonally oriented away from the user while the rotation arm upper bar 54 begins at an angle that is generally horizontal. The user presses against the rotation arm bar handle 56 which rotates the rotation arm lower bar 55. The rotation arm lower bar 55 is rigidly connected to the rotation arm bar handle 56. The rotation arm bar connector 59 is rigidly connected to the rotation arm lower bar 55 and rotates with the rotation arm lower bar 55. The rotation arm bar connector 59 is preferably formed as a slotted plate that rigidly connects such as by welding between the rotation arm upper bar 54 and the rotation arm lower bar 55. The rotation arm abutment 57 can be formed as a metal flat plate that is perpendicular to the plane of the flat plate of the rotation arm bar connector 59. The rotation arm abutment 57 preferably abuts against the left frame stop 46 and the right frame stop 45 of FIG. 3. The rotation arm upper bar 54 rigidly connects to the rotation arm weighed extension 51. The rotation arm weighted extension 51 has a rotation arm rear weight 52 mounted to the end of the rotation arm weighted extension 51. The rotation arm rear weight 52 can be integrally formed with the rotation arm weight extension 51 or can be bolted to the rear tip of the rotation arm weight extension 51.

As seen in the fifth figure, the frame 40 supports a right and left rotation arm 50 the right rotation arm has a right rotation arm bar handle 156 that extends toward the user. The right rotation arm lower bar 155 extends upwardly to the right rotation arm weight joint 158. The right rotation arm upper bar 154 is also preferably connected to the right rotation arm weight joint 158. The right rotation arm upper bar 154 extends rearwardly to the right rotation arm rear weight 152. The left rotation arm has a left rotation arm bar handle 256 that extends toward the user. The left rotation arm lower bar 255 extends upwardly to the left rotation arm weight joint 258. The left rotation arm upper bar 254 is also preferably connected to the left rotation arm weight joint 258. The left rotation arm upper bar 254 extends rearwardly to the left rotation arm rear weight 252.

As seen in the sixth figure, the key feature of the present invention is the adjustable front weight assembly 60. The front weight assembly 60 has a front weight retainer 61 formed as a laterally extending metal tube or rod that extends generally horizontally. The front weight retainer 61 is mounted to a front weight swivel member 62. The front weight swivel member 62 and the front weight retainer 61 swivel on a front weight retainer pivot 63. The front weight swivel member 62 can swivel to adjust the front weight assembly 60 such as by swinging back or forward. The adjustment link 650 keeps the front weight swivel member 62 from swinging freely. A user can adjust a position of the selector body pin 67 by removing the selector body pin 67 from the selector body 64. The selector body pin 67 is mounted on a selector body path 68 and selector body anchor points 69 are formed on the selector body path 68 such that the selector body pin 67 can be engaged to any of the selector body anchor points 69. The selector body link 65 rotates on a selector body link 66 which constrains the selector body pain 67 to the selector body path 68. The selector body path 68 has an arc shaped profile that is preferably a section of a circle such as a third of a circle or a quarter of a circle so that the selector body pin 67 has multiple positions to engage. When the selector body pin 67 engages a lower position, the adjustment link 650 is pushed forward which pushes forward the front weight assembly 60 which makes the weight harder to push. When the selector body pin 67 engages a higher position, the adjustment link 650 is pulled backward and this locks back the front weight assembly 60 which makes weight easier to push. For example, the user can begin a workout with the selector body pin 67 at the highest point and then adjust the selector body pin downwardly with each set. This maximizes the muscle burn and muscle fatigue size to maximize muscle growth. The adjustment link 650, selector body 64, and front weight swivel member 62 all swivel with the rotation arm 50.

As seen in the seventh figure, the right rotation arm 150 has a right rotation arm main joint 153 that is proximal to the selector body 64. Similarly, the left rotation arm 250 has a left rotation arm main joint 253 that is proximal to the selector body 64. The seat 91 preferably includes a backrest 92 and a headrest 93. The upper seatback support member 95 can support the headrest 93. The upper seatback support member 95 can connect to a lower seatback support member 94. The lower seatback support member 94 can support a seat height adjustment assembly 96.

As seen in the eighth figure, the seat height adjustment assembly 96 moves relative to the backrest 92 and the headrest 93. The base of the device has a generally triangular footprint.

As seen in the ninth figure, the right front weight retainer 161 is pivotally connected to a right adjustment link 1650. The right adjustment link 1650 is distal to the right selector body link 165. The right selector body link 165 supports the right front weight retainer 161. The right selector body link 165 is mounted proximally to the right selector body pin 167. The right selector body pin 167 can be spring-loaded so that it pops into the right selector body 164 at predetermined intervals. Similarly, the left front weight retainer 162 is pivotally connected to a right adjustment link 2650. The left adjustment link 2650 is distal to the left selector body link 265. The left selector body link 265 supports the left front weight retainer 261. The left selector body link 265 is mounted proximally to the left selector body pin 267. The left selector body pin 267 can be spring-loaded so that it pops into the left selector body 264 at predetermined intervals.

As seen in the tenth figure, the adjustment link has an adjustment link rear pivot 71 and an adjustment link front pivot 72. The adjustment link passes through a safety retainer 73 that has a safety retainer opening 74. The front weight abuts a front weight retainer stop 75 so that the weight plate does not contact the safety retainer 73. The front weight retainer stop 75 can be formed as an elastomeric stopper such as a silicone sleeve or tube. The selector body link pivot 66 is proximal to the adjustment link rear pivot 71.

As seen in the eleventh through fifteen figures, the link position 80 includes a first link position 81, a second link position 82, a third link position 83, a fourth link position 84, and a fifth link position 85. The link positions 80 are preferably formed as openings that receive the spring-loaded selector body 67 at various intervals. A user can have different positions for the left or right side, but generally would have the same positions for both sides. A user can start with the more difficult lower position such as the first link position 81 and then move the link to the other link positions after a first set of exercise. A removable weight plate 888 fits on the front weight retainer 61.

As seen in the sixteenth figure, a conceptual mechanical diagram shows the adjustable front weight assembly formed as a four bar mechanism or four bar linkage with an adjustment link moving forward and rearwards in a coupler curve. The adjustable front weight assembly is a closed loop linkage with four members, one fixed link and four pin joints. The coupler link or intermediate link here is the adjustment link that traces a coupler curve and has a curve shaped motion. The coupler curve in this case is generally horizontal. The weight adjustability can be kinematically derived using the four bar linkage mechanism model. Although kinematic analysis can produce a variety of different coupler curves, a key feature of the present invention is the adjustment configuration for the adjustable front weight assembly, namely the use of the selector body pin 67 to engage to any of the selector body anchor points 69 for ease of modifying and locking the position of the four bar mechanism.

The invention claimed is:

1. A weight exerciser comprising:

a. a frame, wherein the frame comprises a base;

b. a right rotation arm, wherein the right rotation arm is mounted to the frame at a right rotation arm main joint, wherein the right rotation arm comprises a right rotation arm upper bar, wherein the right rotation arm upper bar is mounted above the base;

c. a left rotation arm, wherein the left rotation arm is mounted to the frame at a left rotation arm main joint, wherein the left rotation arm comprises a left rotation arm upper bar, wherein the left rotation arm upper bar is mounted above the base;

d. a right front weight swivel member, wherein the right front weight swivel member is pivotally connected to the right rotation arm upper bar at a right front weight retainer pivot;

e. a left front weight swivel member, wherein the left front weight swivel member is pivotally connected to the left rotation arm upper bar at a left front weight retainer pivot;

f. a right adjustment link, wherein the right adjustment link is pivotally attached to the right front weight swivel member at a right front weight swivel member pivot;

g. a left adjustment link, wherein the left adjustment link is pivotally attached to the left front weight swivel member at a left front weight swivel member pivot;

h. a right selector body link, wherein the right selector body link is pivotally attached to the right rotation arm upper bar at a right selector body link pivot, wherein the right selector body link is pivotally attached to a right adjustment link rear pivot;

i. a left selector body link, wherein the left selector body link is pivotally attached to the left rotation arm upper bar at a left selector body link pivot, wherein the left selector body link is pivotally attached to a left adjustment link rear pivot;

j. a right front weight retainer, wherein the right front weight retainer is attached to the right front weight swivel member; and k. a left front weight retainer, wherein the left front weight retainer is attached to the left front weight swivel member.

2. The weight exerciser of claim 1, further including a right rotation arm lower bar and a left rotation arm lower bar, wherein the right rotation arm lower bar is rigidly connected to the right rotation arm upper bar, wherein the left rotation arm lower bar is rigidly connected to the left rotation arm upper bar, wherein the right rotation arm lower bar is mounted below the right rotation arm upper bar, wherein the left rotation arm lower bar is mounted below the left rotation arm upper bar.

3. The weight exerciser of claim 2, further including a right rotation arm bar handle and a left rotation arm bar handle, wherein the right rotation arm bar handle is mounted to the right rotation arm lower bar, wherein the left rotation arm bar handle is mounted to the left rotation arm lower bar, wherein the left rotation arm bar handle extends inwardly from the left rotation arm lower bar, wherein the right rotation bar handle extends inwardly from the right rotation arm lower bar.

4. The weight exerciser of claim 1, further including a right rotation arm weight extension extending from the right rotation arm, and a left rotation arm weight extension extending from the left rotation arm.

5. The weight exerciser of claim 1, further including a foot spotter, wherein the foot spotter includes a foot pedal attached to a foot spotter lever, wherein the foot spotter lever is attached to a foot spotter link, wherein the foot spotter link is configured to rotate a foot spotter bar, wherein the foot spotter bar actuates a right spotter lift link and a left spotter lift link, wherein the right spotter lift link is pivotally connected to the right rotation arm, wherein the left spotter lift link is pivotally connected to the left rotation arm, wherein the foot spotter foot pedal actuates the right rotation arm and the left rotation arm upwardly when in a depressed mode.

6. The weight exerciser of claim 1, further including a right selector body and a left selector body, wherein the right selector body is mounted to the right rotation arm upper bar, wherein the left selector body is mounted to the left rotation arm upper bar, wherein the right selector body connects to the right selector body link at a right selector body pin, wherein the left selector body connects to the left selector body link at a left selector body pin, wherein the right selector body pin removably connects to a right selector body anchor points, wherein the left selector body pin removably connects to a left selector body anchor points.

7. The weight exerciser of claim 1, wherein the right selector body anchor points are plural such that there is a first right selector body anchor point, a second right selector body anchor point, a third right selector body anchor point, a fourth right selector body anchor point, and a fifth right selector body anchor point and further comprising a first right link position, a second right link position, a third right link position, a fourth right link position, and a fifth right link position, wherein the first right link position corresponds to the first right selector body anchor point, wherein the second right link position corresponds to the second right selector body anchor point, wherein the third right link position corresponds to the third right selector body anchor point, wherein the fourth right link position corresponds to the fourth right selector body anchor point, wherein the fifth right link position corresponds to the fifth right selector body anchor point, wherein the right selector body pin is configured to engage the first right selector body anchor point, the second right selector body anchor point, the third right selector body anchor point, the fourth right selector body anchor point and the fifth right selector body anchor point; wherein the left selector body anchor points are plural such that there is a first left selector body anchor point, a second left selector body anchor point, a third left selector body anchor point, a fourth left selector body anchor point, and a fifth left selector body anchor point and further comprising a first left link position, a second left link position, a third left link position, a fourth left link position, and a fifth left link position, wherein the first left link position corresponds to the first left selector body anchor point, wherein the second left link position corresponds to the second left selector body anchor point, wherein the third left link position corresponds to the third left selector body anchor point, wherein the fourth left link position corresponds to the fourth left selector body anchor point, wherein the fifth left link position corresponds to the fifth left selector body anchor point, wherein the left selector body pin is configured to engage the first left selector body anchor point, the second left selector body anchor point, the third left selector body anchor point, the fourth left selector body anchor point and the fifth left selector body anchor point.

8. The weight exerciser of claim 7, wherein the right selector body pin is mounted on the selector body link and locks a position of the selector body link, a position of the adjustment link, and a position of the front weight swivel member when the right selector body pin is engaged to the first right selector body, wherein the right selector body pin travels in an arc path when in a free mode, and is locked in a locked mode, wherein the first right selector body anchor point is formed as an opening configured to receive the right selector body pin, wherein the second right selector body anchor point is formed as an opening configured to receive the right selector body pin, wherein the third right selector body anchor point is formed as an opening configured to receive the right selector body pin, wherein the fourth right selector body anchor point is formed as an opening to receive the right selector body pin, wherein the fifth selector body anchor point is formed as an opening to receive the right selector body pin; wherein the left selector body pin is mounted on the selector body link and locks a position of the selector body link, a position of the adjustment link, and a position of the front weight swivel member when the left selector body pin is engaged to the first left selector body, wherein the left selector body pin travels in an arc path when in a free mode, and is locked in a locked mode, wherein the first left selector body anchor point is formed as an opening configured to receive the left selector body pin, wherein the second left selector body anchor point is formed as an opening configured to receive the left selector body pin, wherein the third left selector body anchor point is formed as an opening configured to receive the left selector body pin, wherein the fourth left selector body anchor point is formed as an opening to receive the left selector body pin, wherein the fifth selector body anchor point is formed as an opening to receive the left selector body pin.

9. The weight exerciser of claim 8, further including a right rotation arm lower bar and a left rotation arm lower bar, wherein the right rotation arm lower bar is rigidly connected to the right rotation arm upper bar, wherein the left rotation arm lower bar is rigidly connected to the left rotation arm upper bar, wherein the right rotation arm lower bar is mounted below the right rotation arm upper bar, wherein the left rotation arm lower bar is mounted below the left rotation arm upper bar.

10. The weight exerciser of claim 9, further including a right rotation arm bar handle and a left rotation arm bar handle, wherein the right rotation arm bar handle is mounted to the right rotation arm lower bar, wherein the left rotation arm bar handle is mounted to the left rotation arm lower bar, wherein the left rotation arm bar handle extends inwardly from the left rotation arm lower bar, wherein the right rotation bar handle extends inwardly from the right rotation arm lower bar.

11. The weight exerciser of claim 8, further including a right rotation arm weight extension extending from the right rotation arm, and a left rotation arm weight extension extending from the left rotation arm.

12. The weight exerciser of claim 8, further including a foot spotter, wherein the foot spotter includes a foot pedal attached to a foot spotter lever, wherein the foot spotter lever is attached to a foot spotter link, wherein the foot spotter link is configured to rotate a foot spotter bar, wherein the foot spotter bar actuates a right spotter lift link and a left spotter lift link, wherein the right spotter lift link is pivotally connected to the right rotation arm, wherein the left spotter lift link is pivotally connected to the left rotation arm, wherein the foot spotter foot pedal actuates the right rotation arm and the left rotation arm upwardly when in a depressed mode.

13. The weight exerciser of claim 8, further including a right selector body and a left selector body, wherein the right selector body is mounted to the right rotation arm upper bar, wherein the left selector body is mounted to the left rotation arm upper bar, wherein the right selector body connects to the right selector body link at a right selector body pin, wherein the left selector body connects to the left selector body link at a left selector body pin, wherein the right selector body pin removably connects to a right selector body anchor point, wherein the left selector body pin removably connects to a left selector body anchor point.

14. A weight exerciser comprising:

a. a frame, wherein the frame comprises a base;

b. a right rotation arm, wherein the right rotation arm is mounted to the frame at a right rotation arm main joint, wherein the right rotation arm comprises a right rotation arm upper bar, wherein the right rotation arm upper bar is mounted above the base;

c. a left rotation arm, wherein the left rotation arm is mounted to the frame at a left rotation arm main joint, wherein the left rotation arm comprises a left rotation arm upper bar, wherein the left rotation arm upper bar is mounted above the base;

d. a right front weight swivel member, wherein the right front weight swivel member is pivotally connected to the right rotation arm upper bar at a right front weight retainer pivot;

e. a left front weight swivel member, wherein the left front weight swivel member is pivotally connected to the left rotation arm upper bar at a left front weight retainer pivot;

f. a right adjustment link, wherein the right adjustment link is pivotally attached to the right front weight swivel member at a right front weight swivel member pivot;

g. a left adjustment link, wherein the left adjustment link is pivotally attached to the left front weight swivel member at a left front weight swivel member pivot;

h. a right selector body link, wherein the right selector body link is pivotally attached to the right rotation arm upper bar at a right selector body link pivot, wherein the right selector body link is pivotally attached to a right adjustment link rear pivot;

i. a left selector body link, wherein the left selector body link is pivotally attached to the left rotation arm upper bar at a left selector body link pivot, wherein the left selector body link is pivotally attached to a left adjustment link rear pivot;

j. a right front weight retainer, wherein the right front weight retainer is attached to the right front weight swivel member;

k. a left front weight retainer, wherein the left front weight retainer is attached to the left front weight swivel member;

l. A right rotation arm lower bar and a left rotation arm lower bar, wherein the right rotation arm lower bar is rigidly connected to the right rotation arm upper bar, wherein the left rotation arm lower bar is rigidly connected to the left rotation arm upper bar, wherein the right rotation arm lower bar is mounted below the right rotation arm upper bar, wherein the left rotation arm lower bar is mounted below the left rotation arm upper bar;

m. a right rotation arm bar handle and a left rotation arm bar handle, wherein the right rotation arm bar handle is mounted to the right rotation arm lower bar, wherein the left rotation arm bar handle is mounted to the left rotation arm lower bar, wherein the left rotation arm bar handle extends inwardly from the left rotation arm lower bar, wherein the right rotation bar handle extends inwardly from the right rotation arm lower bar;

n. a right rotation arm weight extension extending from the right rotation arm, and a left rotation arm weight extension extending from the left rotation arm;

o. a foot spotter, wherein the foot spotter includes a foot pedal attached to a foot spotter lever, wherein the foot spotter lever is attached to a foot spotter link, wherein the foot spotter link is configured to rotate a foot spotter bar, wherein the foot spotter bar actuates a right spotter lift link and a left spotter lift link, wherein the right spotter lift link is pivotally connected to the right rotation arm, wherein the left spotter lift link is pivotally connected to the left rotation arm, wherein the foot spotter foot pedal actuates the right rotation arm and the left rotation arm upwardly when in a depressed mode;

p. a right selector body and a left selector body, wherein the right selector body is mounted to the right rotation arm upper bar, wherein the left selector body is mounted to the left rotation arm upper bar, wherein the right selector body connects to the right selector body link at a right selector body pin, wherein the left selector body connects to the left selector body link at a left selector body pin, wherein the right selector body pin removably connects to a right selector body anchor points, wherein the left selector body pin removably connects to a left selector body anchor points, wherein the right selector body anchor point is plural such that there is a first right selector body anchor point, a second right selector body anchor point, a third right selector body anchor point, a fourth right selector body anchor point, and a fifth right selector body anchor point and further comprising a first right link position, a second right link position, a third right link position, a fourth right link position, and a fifth right link position, wherein the first right link position corresponds to the first right selector body anchor point, wherein the second right link position corresponds to the second right selector body anchor point, wherein the third right link position corresponds to the third right selector body anchor point, wherein the fourth right link position corresponds to the fourth right selector body anchor point, wherein the fifth right link position corresponds to the fifth right selector body anchor point, wherein the right selector body pin is configured to engage the first right selector body anchor point, the second right selector body anchor point, the third right selector body anchor point, the fourth right selector body anchor point and the fifth right selector body anchor point; wherein the left selector body anchor point is plural such that there is a first left selector body anchor point, a second left selector body anchor point, a third left selector body anchor point, a fourth left selector body anchor point, and a fifth left selector body anchor point and further comprising a first left link position, a second left link position, a third left link position, a fourth left link position, and a fifth left link position, wherein the first left link position corresponds to the first left selector body anchor point, wherein the second left link position corresponds to the second left selector body anchor point, wherein the third left link position corresponds to the third left selector body anchor point, wherein the fourth left link position corresponds to the fourth left selector body anchor point, wherein the fifth left link position corresponds to the fifth left selector body anchor point, wherein the left selector body pin is configured to engage the first left selector body anchor point, the second left selector body anchor point, the third left selector body anchor point, the fourth left selector body anchor point and the fifth left selector body anchor point, wherein the right selector body pin is mounted on the selector body link and locks a position of the selector body link, a position of the adjustment link, and a position of the front weight swivel member when the right selector body pin is engaged to the first right selector body, wherein the right selector body pin travels in an arc path when in a free mode, and is locked in a locked mode, wherein the first right selector body anchor point is formed as an opening configured to receive the right selector body pin, wherein the second right selector body anchor point is formed as an opening configured to receive the right selector body pin, wherein the third right selector body anchor point is formed as an opening configured to receive the right selector body pin, wherein the fourth right selector body anchor point is formed as an opening to receive the right selector body pin, wherein the fifth selector body anchor point is formed as an opening to receive the right selector body pin; wherein the left selector body pin is mounted on the selector body link and locks a position of the selector body link, a position of the adjustment link, and a position of the front weight swivel member when the left selector body pin is engaged to the first left selector body, wherein the left selector body pin travels in an arc path when in a free mode, and is locked in a locked mode, wherein the first left selector body anchor point is formed as an opening configured to receive the left selector body pin, wherein the second left selector body anchor point is formed as an opening configured to receive the left selector body pin, wherein the third left selector body anchor point is formed as an opening configured to receive the left selector body pin, wherein the fourth left selector body anchor point is formed as an opening to receive the left selector body pin, wherein the fifth selector body anchor point is formed as an opening to receive the left selector body pin.

* * * * *